United States Patent [19]

Brown

[11] Patent Number: 4,718,518

[45] Date of Patent: Jan. 12, 1988

[54] STEP LADDER

[76] Inventor: William E. Brown, 3228 South St., Hollywood, Fla. 33021

[21] Appl. No.: 931,350

[22] Filed: Nov. 17, 1986

[51] Int. Cl.[4] ..... E06C 7/42; E06C 7/50

[52] U.S. Cl. ..... 182/22; 182/165; 182/178; 182/228

[58] Field of Search ..... 182/178, 179, 228, 107, 182/22, 165

[56] References Cited

U.S. PATENT DOCUMENTS

| | | | |
|---|---|---|---|
| 375,079 | 12/1887 | Luzmoor | 182/178 |
| 1,895,213 | 1/1933 | Stindl | 182/178 |
| 1,942,210 | 1/1934 | Harting | 182/22 |
| 2,396,028 | 3/1946 | Spayd | 182/178 |
| 2,517,991 | 8/1950 | Eddy | 182/178 |
| 4,086,980 | 5/1978 | Shortes | 182/151 |

*Primary Examiner*—Reinaldo P. Machado
*Attorney, Agent, or Firm*—Joseph Zallen

[57] ABSTRACT

A convertible step ladder having a back section (13) comprising a pair of rails (101, 102) cooperable with a detachable section (16) provides a step ladder that can be used on stairs as well as a flat surface. The detachable section has a horizontal cross member (168) spanning a pair of channels (162, 163) having orifices (**162*a*, 163*a*) and bolts (166, 167). The rails (101, 102) seat in the channels on the cross member and have orifices (102*b*) registering with orifices (162*a*, 163*a*) whereby insertion of the rails (101, 102) onto the cross member (168) permits locking of the channels together by insertion of the bolts (166, 167**) into the corresponding orifices.

1 Claim, 4 Drawing Figures

STEP LADDER

BACKGROUND OF THE INVENTION

This invention relates to a step ladder and, in particular, to a step ladder that can sit properly on a flight of stairs.

Step ladders of various configurations have long been known. Examples of the prior art on step ladders include U.S. Pat. Nos. 131,442; 455,973; 1,379,419; 1,672,020; and 3,037,580. Such patents include step ladders that are self leveling or have extensions or can be adjusted for uneven surfaces. However, none of the prior art step ladders address the problem of positioning a step ladder on a flight of stairs so as to enable a painter or carpenter or other worker to have a safe and secure means of climbing and doing work on an elevated position such as a wall or ceiling adjacent to a flight of stairs.

One object of the present invention is to provide a step ladder that can be used in a conventional way but also on a flight of stairs.

Other objects and advantages of this invention will be apparent from the description and claims which follow taken together with the appended drawings.

Figure 2:
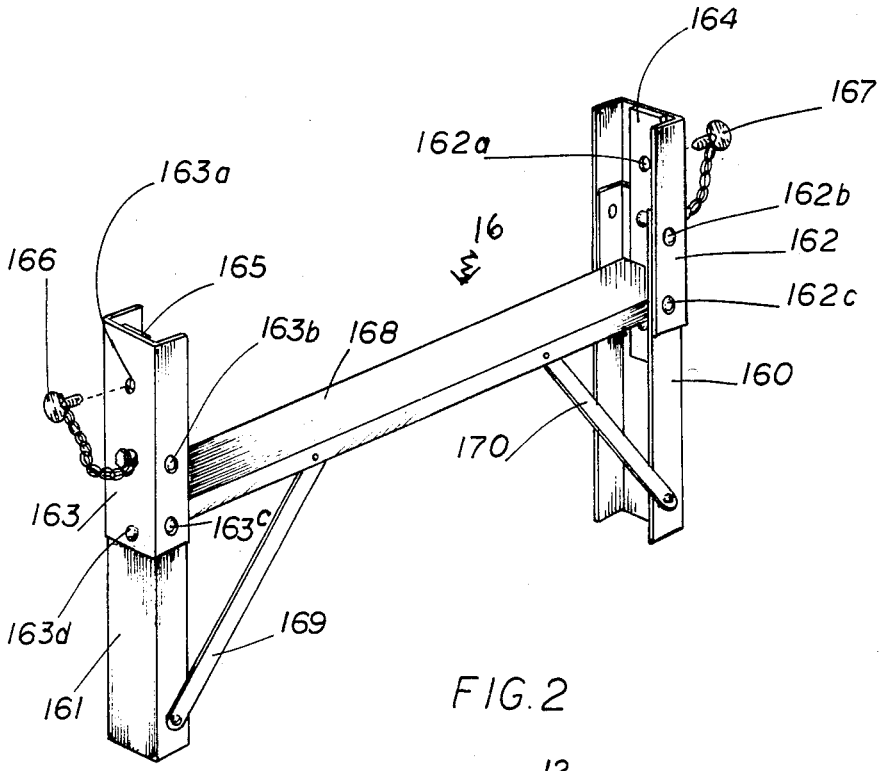
FIG. 2 is a perspective view of the lower rear detachable portion of the step ladder.
Figure 1:
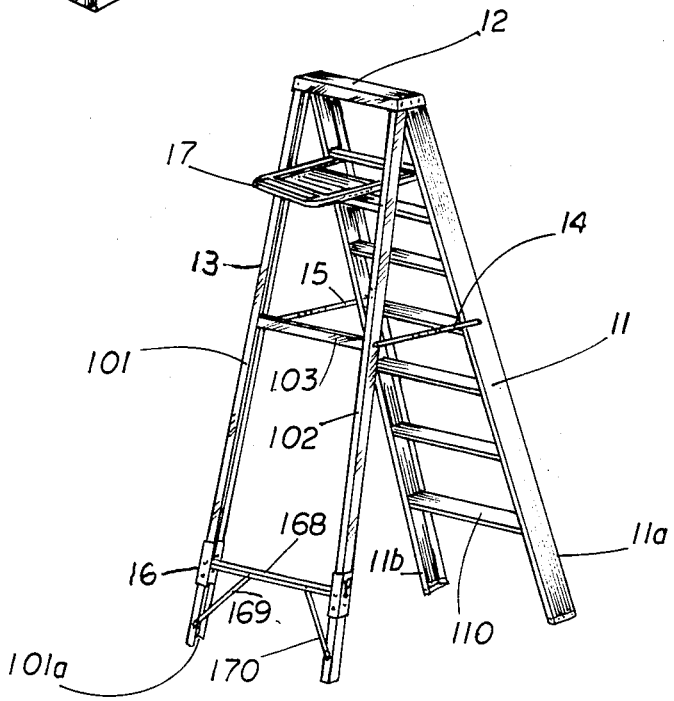
FIG. 1 is a perspective view of an example of this invention showing the step ladder in its conventional form.

Referring now to the drawings, the step ladder illustrated therein comprises a front section 11 having a left side rail 11*a* and a right side rail 11*b*. A flat top section 12 is attached to front section 11 and pivotally connected to the ladder back section 13. Foldable links 14 and 15 connect between the front and back sections 11 and 13 of the ladder. A foldable conventional paint pail support 17 is spaced below the top step 12.

The back section 13 comprises 2 channel rails 101 and 102 which are connected to the bottom rear detachable section 16. Section 16 comprises right bottom channel member 161, and left bottom channel member 160 which are inserted and joined to left upper channel member 162 and right upper channel member 163 by rivets 162*b* and 162*c*. The 2 pairs of vertical channels are spanned by cross member 168 with struts 169 and 170 extending between the cross member and the pairs of channels. Stiffening bars 164 and 165 are spaced in the pairs of channels where the cross member 168 joins. Rivets 163*c*, 163*d*, and 162*c* attach the cross member 168 firmly to the channel members and the stiffening bars.

The detachable section 16 is attached to the legs 101 and 102 by means of bolts 166 and 167 extending through orifices 163*a* and 162*a* into registering orifices 102*b* in the rear legs.

Figure 4:
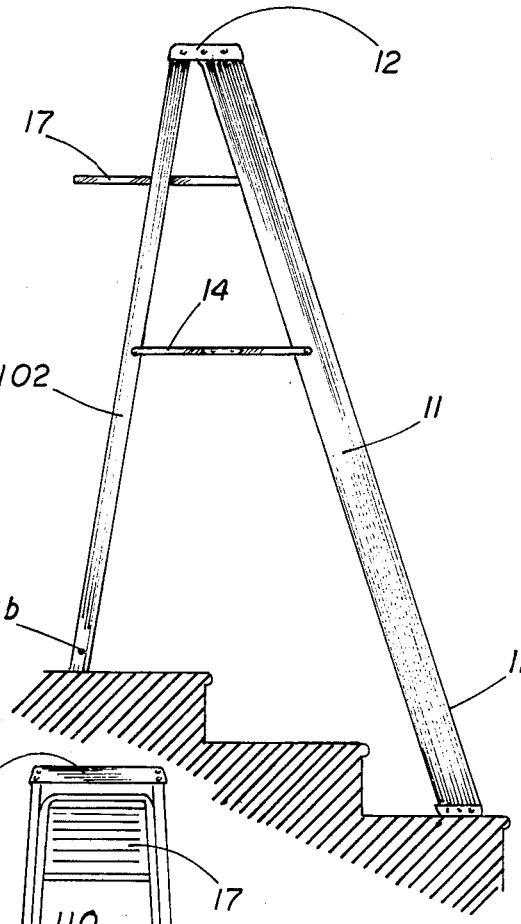
FIG. 4 is a side view of the step ladder of FIG. 3 in position on a flight of stairs.
Figure 3:
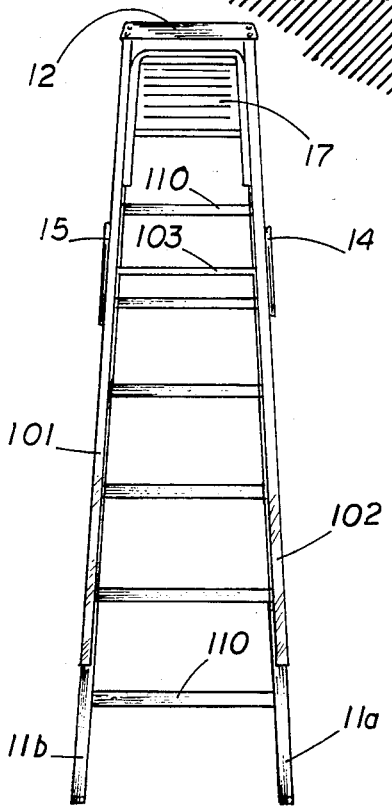
FIG. 3 is a rear view of the ladder folded with the bottom section removed.

As shown particularly in FIG. 4, the ladder can stay level on a flight of stairs when the detachable section 16 is removed, thus enabling a firm and secure step ladder for use by a person wanting to do work on the walls or ceiling adjacent to a flight of stairs.

When the need for work on the stairs is completed, the rear bottom section 16 can be readily attached by inserting the channels in one another whereby legs 101 and 102 sit readily on cross member 168 and locking bolts 166 and 167 can be inserted. The result is now a conventional step ladder which can be used on ordinary flat surfaces.

What is claimed is:

1. A convertible step ladder having a back section (13) comprising a pair of rails (101, 102) in combination with a detachable section (16); said detachable section comprising leg portion (160, 161) and an upper portion comprising a horizontal cross member (168) spanning a pair of channel means (162, 163) having first orifices (162*a*, 163*a*) and bolts (166, 167); said rails (101, 102) seating in said channel means on said cross member and having second orifices (102*b*) registering with orifices (162*a*, 163*a*); said channels being locked together by insertion of bolts (166, 167) into the corresponding orifices; said ladder being so characterized that when said detachable section is removed the back section is shorter than the front section and can rest on a higher step on a flight of stairs than the front section and yet be level.

* * * * *